United States Patent [19]

Tsien

[11] 4,087,862

[45] May 2, 1978

[54] BLADELESS MIXER AND SYSTEM

[75] Inventor: Hsue C. Tsien, Livingston, N.J.

[73] Assignee: Exxon Research & Engineering Co., Linden, N.J.

[21] Appl. No.: 735,624

[22] Filed: Oct. 26, 1976

Related U.S. Application Data

[63] Continuation-in-part of Ser. No. 639,825, Dec. 11, 1975, abandoned.

[51] Int. Cl.[2] ..... B01F 5/00; B01F 5/06

[52] U.S. Cl. ..... 366/165; 366/184; 366/340; 366/341

[58] Field of Search ..... 259/4 R, 18, 36, 60, 259/2, 4 A, 4 AC, 95; 34/10, 57 R

[56] References Cited

U.S. PATENT DOCUMENTS

| | | | |
|---|---|---|---|
| 2,890,868 | 6/1959 | Potchen | 259/4 R |
| 3,233,872 | 2/1966 | Bouyoucos | 259/4 R |
| 3,404,869 | 10/1968 | Harder | 259/4 R |
| 3,856,269 | 12/1974 | Fothergill | 259/18 |

FOREIGN PATENT DOCUMENTS

| | | | |
|---|---|---|---|
| 1,031,284 | 6/1958 | Germany | 259/4 R |
| 987,954 | 3/1965 | United Kingdom | 259/4 R |

*Primary Examiner*—Robert W. Jenkins
*Attorney, Agent, or Firm*—F. Donald Paris

[57] ABSTRACT

A bladeless mixing device for use in a mixing system to mix streams of the same or different composition, for example, liquid/liquid, gas/gas, solid/solid, or any combination thereof. In the mixer device streams are tangentially directed into an inlet mixing chamber comprising a convergent conical cavity wherein a converging vortex is created, which is passed through an orifice into an outlet mixing chamber comprising a divergent conical cavity wherein a diverging vortex is developed, which is extracted from the outlet cavity tangentially for subsequent passage through further stages of the mixing system. The streams are combined, separated and recombined several times during the course of their passage through the mixing system which comprises a plurality of stages, until the desired mixing is obtained. The orifice size may be varied, depending upon the extent of mixing and velocity required for thorough mixing of the streams.

34 Claims, 13 Drawing Figures

Fig. 1.
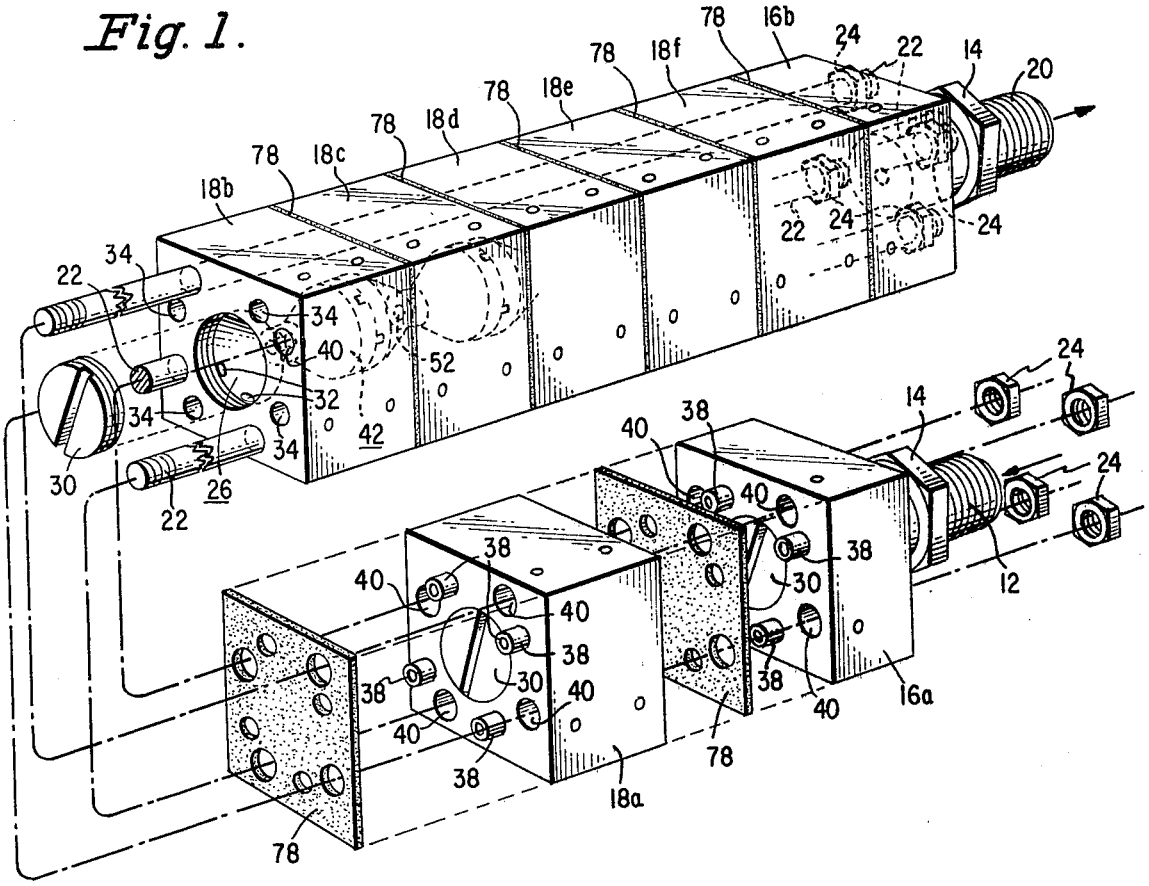
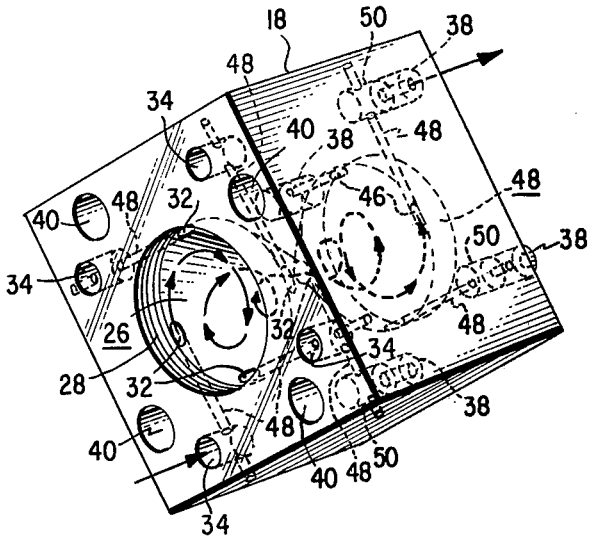
Fig. 2.

Fig. 3.
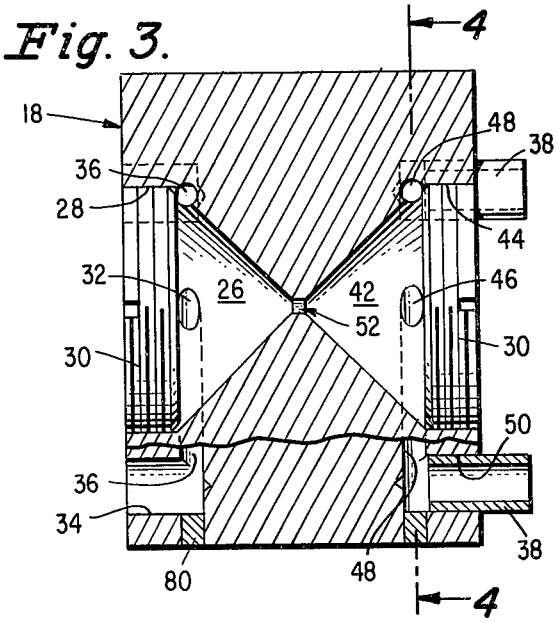
Fig. 4.
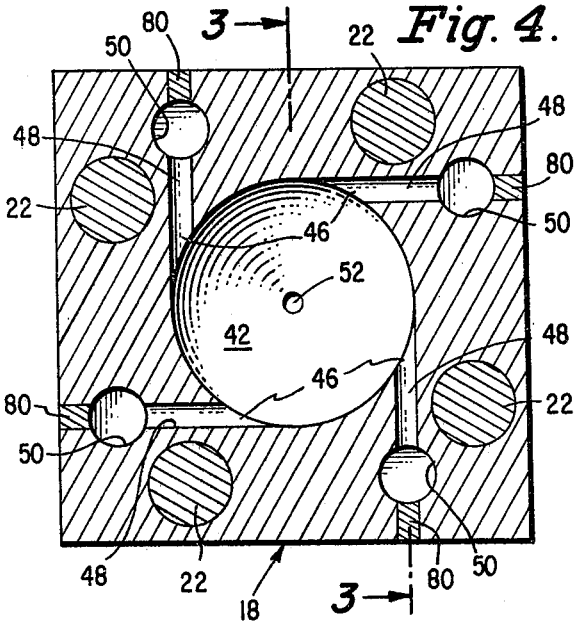
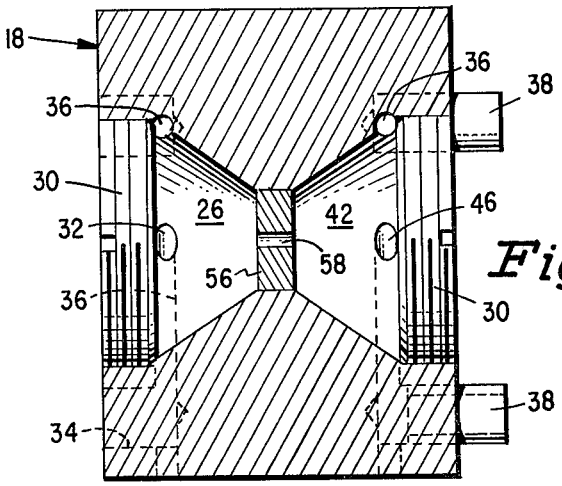
Fig. 5.
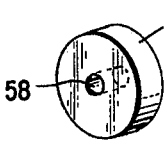
Fig. 6.
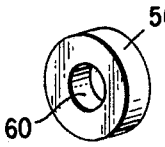
Fig. 7.
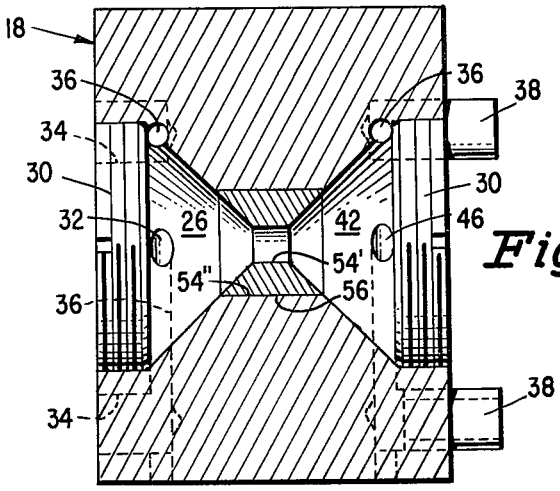
Fig. 8.
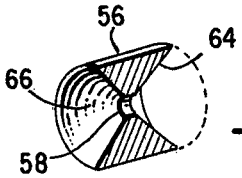
Fig. 9.
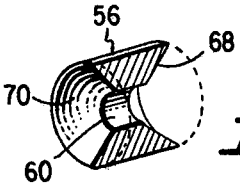
Fig. 10.

BLADELESS MIXER AND SYSTEM

CROSS-REFERENCE TO RELATED APPLICATIONS

This application is a continuation-in-part application of U.S. Ser. No. 639,825, filed Dec. 11, 1975, now abandoned assigned to the same assignee of the present application and invention, which is incorporated herein by reference.

BACKGROUND OF THE INVENTION

Oftentimes it is desired to mix flowing streams to produce desirable effects such as homogenization of the streams, thorough intermixing, establishment of uniform temperatures throughout the resulting stream and the like. Preferably, it is desirable to accomplish such mixing in a relatively static environment, that is, one in which there is a minimum of parts and most preferably no moving parts. Such mixers commonly have been referred to as static or motionless mixers and the mixing referred to as static mixing. Thus, while the physical interaction of the various streams which are to be mixed is produced, there are no physically moving structural elements or parts in the overall system which has obvious advantages.

The principle of static mixing by the use of helically-arranged passageways for use in in-line mixing of liquid streams is well known in the art as disclosed in the article, "Motionless Mixers" by Richard Devellian, AUTOMATION MAGAZINE, February 1972, pages 46 through 48. Other prior art which is typical of such mixing and mixers may be found by reference to U.S. Pat. Nos. 3,860,217 and 3,286,992. These static mixers, however, all basically have some sort of helical element or tubular channel which is fixed or secured to the interior of a tubular member or pipe, which has the obvious disadvantage of making the flow passageway very difficult to clean after the streams have been mixed. Also, the basic design parameters are fixed once the internal elements have been inserted or secured in place, thus making it very difficult and perhaps impossible to shorten or lengthen the mixing chamber after the design has been fixed.

Other prior art illustrative of this general area of technology includes U.S. Pat. No. 2,719,112, assigned to the assignee of the present invention, wherein a gas/-solid contact system is disclosed. In this system the solid is normally within the vessel and to provide the desired contacting, a gas vortex flow is superimposed on the solid. Still further prior art patents include U.S. Pat. Nos. 3,261,593 and 3,391,908.

SUMMARY OF THE INVENTION

The present invention relates to a device, system and/or method which provides improved mixing of a plurality of streams and which eliminates the disadvantages of the prior art and has the advantages and benefits which will be apparent from this disclosure. In accordance with the present invention, a plurality of streams which may comprise liquid/liquid, gas/gas, solid/solid in slurry or non-slurry form, or combinations thereof, is introduced tangentially into a conically-shaped inlet mixing chamber or cavity which is designed to create a vortex of increasing rotational velocity. The inlet chamber is a converging cone which develops a converging vortex having increasing rotational kinetic energy which the is translated linearly through an orifice at the apex of the cavity wherein it is converted into translational (that is, linear) kinetic energy. This translational kinetic energy then is converted back into rotational kinetic energy having a decreasing rotational velocity, as the mixture emerges from the orifice into the conically-shaped divergent mixing chamber or cavity on the outlet side of the orifice. Outlet passageways are tangentially arranged at the far end of the outlet chamber such that the direction of the outlet vortex is opposite to that of the inlet vortex. The outlet vortex then is passed on to the next adjacent stage of the mixer. The conversion from the rotational to translational kinetic energy and vice versa, is carried out automatically within the mixer system in order to effectively mix the streams, with an accompanying minimum pressure drop and pumping loss.

One aspect of the invention includes providing a variable sized orifice or orifices throughout the stages of the mixer system to alter the kinetic energy and therefore, the mixing of the streams during the mixing process. This may be accomplished in a number of ways, either by designing each mixer stage to have a fixed orifice of different size, or adapting each stage to accommodate different sized orifices by insertion of a predetermined size bushing at the apex of the conical mixing chambers or any combination thereof throughout the mixing system.

The number of stages employed may vary with the degree of mixing desired. If we were to assume that N equals the number of stages in the mixer and X equals the number of streams in each stage, then the particle fraction, that is, the size of the particles which make up the resultant mixture at the end of N stages, will be $1/X^n$ with respect to the particles of the incoming streams. This type of dividing and recombining in geometric progression in, e.g., 20 stages and two streams, would result in a particle size of $1/2^{20}$ or approximately $1/10^6$. This effectively means that the mixing is done in microscopic sizes.

According to another aspect of the invention, each mixing stage can be fabricated by injection molding with all or some of the necessary chambers, openings and orifices being formed during the molding process or subsequently by milling.

It is apparent from the foregoing and will be further apparent from the invention described in greater detail below, that there has been provided a mixer system and device and method which provides for division and recombination of streams in geometrical progression wherein there is a conversion of rotational to translational, e.g. linear, kinetic energy and vice versa, with a minimum pressure drop and a controlled amount of turbulence, which is adaptable for in-line operation and easily manufactured.

Having in mind the foregoing that will be evident from an understanding of this disclosure, the invention comprises the combination, arrangement and devices and methods as disclosed in the presently preferred embodiment of the invention which is hereinafter set forth in such detail as to enable those skilled in the art readily to understand the function, operation and construction and advantages of it when read in conjunction with the accompanying drawings.

BRIEF DESCRIPTION OF THE DRAWINGS

FIG. 1 is a diassembled perspective view of a mixer system constructed in accordance with the present invention and including a plurality of mixing stages in accordance with the present invention, for use in mixing a plurality of streams.

FIG. 2 is an enlarged perspective view of a typical mixing stage of the mixer of FIG. 1, constructed in accordance with the present invention.

FIG. 3 is a cross-sectional view taken substantially on the line 3—3 of FIG. 4, of a mixing stage of FIG. 1, sealed at its ends.

FIG. 4 is a cross-sectional view taken substantially on the line 4—4 of FIG. 3.

FIG. 5 is a cross-sectional view similar to that of FIG. 3, only showing a different stage of the mixer, with a different type of orifice than in FIG. 3.

FIGS. 6 and 7 are enlarged views of typical orifice bushings which can be employed in a mixing stage according to the present invention.

FIG. 8 is a cross-sectional view of a mixing stage in accordance with the present invention, including a different type orifice from that of FIGS. 3 and 5.

FIGS. 9, 10 and 11 illustrate different types of orifice bushings which may be employed in mixing devices according to the present invention.

DESCRIPTION OF THE PREFERRED EMBODIMENTS

Figure 12:
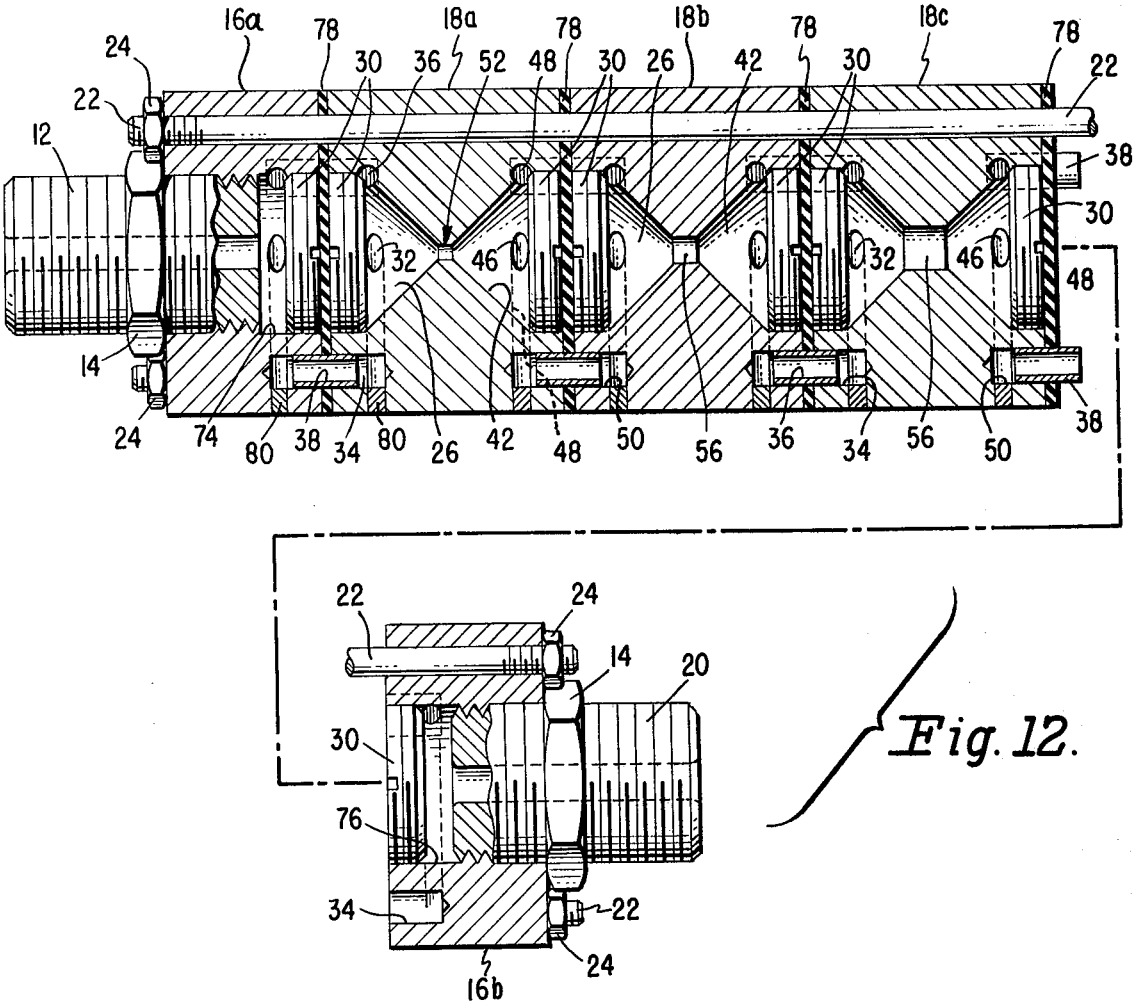
FIG. 12 is a longitudinal cross-sectional view of a mixer system assembled and constructed and arranged in accordance with the present invention, including different size orifices in the various stages.

Referring now to the drawings wherein like parts are designated by the same reference numerals throughout the several views, there is illustrated in FIG. 1 a mixer which comprises a plurality of stages, the number of which is determined by the extent of mixing desired. This mixer, generally designated 10, while shown as comprising six stages and inlet and outlet stages, obviously may comprise whatever number is desired for each particular situation. The mixer 10 comprises an inlet conduit 12 which can be connected for receiving a plurality of inlet streams from separate conduits (not shown). The conduit 12 is secured by conventional means 14, which may comprise a hex nut or the like, to an inlet stage 16*a*. The inlet stage partially mixes the streams and then tangentially ejects them, transferring them to subsequent interconnected mixing stages 18*a* through 18*f* in a manner to be described in greater detail hereinafter. Finally, the resultant mixture is transferred into the outlet stage 16*b*, which may be essentially a mirror image of the inlet stage 16*a*. This resulting mixture then is transferred to the outlet conduit 20, which is similar to the inlet conduit 12 and is connected conventionally also by means such as a hex nut 14 or the like to the outlet stage 16*b*, for subsequent transfer to the process or system in which it is to be used. The external configuration of the stages is shown as being rectangular, although the exterior design can be otherwise (e.g., cylindrical, etc.) and does not form a critical part of the present invention. The stages are interconnected by means of bolts 22 threaded at opposite ends thereof, four of which are shown, with one being located in each corner of the mixer. The stages of the mixer are secured together by means of fastening the hex nuts 24 at opposite ends of each bolt.

Turning now to FIG. 2, there is illustrated an enlarged version of a typical one of the identical mixing stages 18*a* through 18*f* of FIG. 1. This stage, as described heretofore, has an external appearance which is essentially square preferably made of stainless steel. The type of material employed may vary depending upon the use and/or environment in which it is intended for use. For example, while steel is preferred, other materials such as polypropylene, polyethylene, PVC (polyvinyl chloride), tantalum, titanium and the like also can be used. The member 18 includes an inlet mixing chamber or cavity 26, which has a convergent conical configuration that extends from one end of the member 18 toward the opposite end thereof, its apex being substantially between the two ends and preferably midway of the member. At the base end of the inlet chamber 26 about its periphery, the chamber is threaded as shown at 28 to receive a sealing plug 30 (see FIG. 1). The streams are fed into the inlet mixing chamber via the spaced inlet passageways designated 32, each of which is tangentially arranged with respect to the inner surface or periphery of the conical cavity 26. A longitudinal or axial extending passageway 34 is formed for a predetermined distance inward from the inlet end surface of the mixing device 18, and a passageway 36 perpendicular to passageway 34 then is drilled in the member to meet the longitudinal passageway and thus create the tangential inlet 32. The passageway is formed by drilling directly from the exterior of the member inward until communication with the mixing cavity. The portion of the passageway 36 between the axial passageway 34 and exterior of member 18 is filled with solid rods or epoxy as shown at 80. These longitudinal passageways are adapted to receive tubular stream transfer members 38 which interconnect with corresponding passageways 34 in adjacent mixing stages. Also provided in each of the mixing devices are four bores 40 located substantially at each of the corners of the device and extending through the member for receiving the bolt 22 therethrough in order to connect the mixer stages to provide the mixing system. The outlet portion of each mixing stage 18 includes a similar mixing chamber or conically-shaped mixing cavity to that at the inlet, only it essentially is a mirror-type image of the inlet end. On the outlet side there is provided the mixing cavity 42, which is divergent having its apex situated adjacent the apex of the inlet cavity 26 and its base located at the opposite side of the mixing stage from the inlet side. The cavity 42 is threaded at 44 at its base end similar to the threads 28, for receiving a sealing plug 30 similar to that received on the inlet side. Thus the stream mixture as it emerges into the outlet cavity 42 will have an expanding vortex (shown by the arrow path) which will exit through outlet passageways 46, each of which comprises a perpendicularly arranged outlet opening 48 which communicates with the longitudinal or axial extending outlet opening 50 which receives tubular transfer members 38 for transferring the mixture to the next succeeding stage in a manner similar to that described heretofore with respect to the inlet side of the mixing stage 18.

Figure 11:
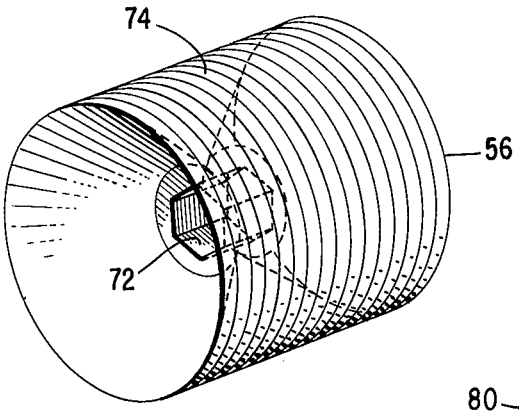

The inlet and outlet conic mixing cavities 26 and 42 are interconnected through an orifice generally designated 52. This orifice may comprise a variety of different forms and configurations as will be apparent from this disclosure. For example, the size of the orifice in a particular stage or stages may be set initially at a certain dimension, or an insert such as a bushing might be employed in order to vary the size of the orifice as described hereinafter. The apex of the inlet and outlet cavities can be directly adjacent, i.e., contiguous, each other without any insert. The size of the orifice will help determine the velocity of the stream flowing therethrough. However, if it is desired to vary the size of the orifice, according to a preferred embodiment, at the location directly adjacent the apex of each cavity a circumferential surface 54 is formed to receive an insert 56 in the form of an annular bushing having a central opening or orifice 58 of desired size. As shown in FIG. 6, the size of the particular orifice 58 can vary from that illustrated wherein the orifice is relatively small, to an annular bushing having a central opening 60 as shown in FIG. 7 wherein the orifice is relatively larger in size. The selection of the size of the orifice depends upon the extent of mixing desired. A small opening will cause an increase in the velocity of the vortex received from the inlet mixing chamber, while a larger opening will result in a lower flow velocity. This means that the residence time will be longer with a larger opening, however, with a correspondingly less effective recombination of streams. The bushing can be inserted and held in place merely by a pressed frictional fit between the insert and the smooth surface 54 situated between the cavities or threaded at 74 as shown in FIG. 11 and described in further detail hereinafter. The inserts 56 may include not only different size orifices such as 58 and 60, but also can include a converging conical inlet 64 or 68 and a diverging conical outlet 66 or 70, which substantially complement the conical configurations of the inlet and outlet cavities 26 and 40, respectively, with which they are associated. This construction and arrangement avoids the presentation of any surface obstruction to the rotational flow of the mixed streams as they enter the orifice. See FIGS. 9 and 10 which illustrate different degrees of divergence and convergence for the inlet and outlet of the inserts, depending on the orifice size. As shown in FIG. 8, the cylindrical surface situated between the cavities is varied in length (54', 54'') by changing the radius of the opening, in order to accommodate inserts having orifices of different size. As shown in FIG. 11, the invention also contemplates employing an insert 56 which has an orifice 72 comprising a hexagonal configuration which will accommodate a hexagonal wrench. This insert 56 includes a convergent inlet portion and divergent outlet portion similar to those (64, 68 and 66, 70) of the other orifice inserts described heretofore. The advantages of this latter type of orifice insert permits insertion of a hexagonal wrench into the hexagonal opening 72 which comprises the orifice, for easy installation and/or removal from each of the mixing devices. The insert is threaded about its periphery as shown at 74 for threaded engagement with complementary threads provided in the orifice 54 of the mixing device. Similar threads can be provided on the inserts shown in the other figures.

The inlet stage **16*a* and outlet stage 16*b* for each mixing system can be substantially like one half of the aforedescribed typical mixing stage of FIG. 2. Thus, the inlet stage 16*a* includes a chamber 74 which may be cylindrical or a polygonal cavity and the outlet stage 16*b* also would comprise a chamber 76 similar to the chamber 74 at the inlet stage 16*a* of the mixing system. To interconnect the various stages as disclosed heretofore, the number of stages desired are aligned and the bolts 22 then passed through the aligned openings 40. Each of the stages includes the threaded sealing plugs 30 for closing the conical mixing chambers 26, 46 with which they are associated. As a further guarantee to prevent leakage between stages, while each of the threaded plugs 30 is sufficient, there also is provided between adjacent stages a gasket seal 78, preferably made of teflon, viton, RTV (room temp. vulcanized rubber or silicone rubber. This gasket seal is designed to align with the various transfer stream connections 38 between adjacent stages and also to accommodate the bolts 22** which extend through and interconnect the mixing stages.

Figure 13:
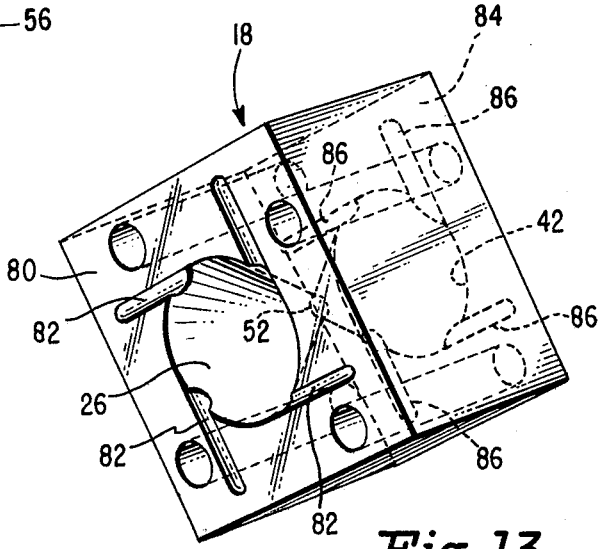
FIG. 13 is a perspective view of another embodiment of the present invention illustrating a mixing stage fabricated by injection molding.

While it has been disclosed that screw plugs 30 are employed in order to provide a seal against leakage between adjacent stages as well as at the ends thereof, it is also contemplated that in lieu of the threaded screw plugs that it would suffice to employ only a gasket seal 78 made of an appropriate material as described above. This gasket seal may be inert, but semi-rigid in strength such that it will serve not only as a gasket but also as a partition between adjacent stages of the mixing units. Thus, it is within the contemplation of the invention to completely omit the screw plugs in the embodiment described heretofore as well as in the alternate embodiment illustrated and described in connection with FIG. 13 wherein the mixing stages are injection molded. Typically, the inert gasket material may have a 1/16 inch thickness, although other dimensions are certainly within the contemplation of this invention. While it has been described that the stage can be made of stainless steel or other materials such as polypropylene, polyethylene, etc., when the latter materials are employed it permits a simplification and cost reduction in the fabrication of each stage. When the stages are made with these materials they can be fabricated by a conventional injection molding process. In this manner then it will not be necessary to drill holes in order to form the tangential passageways such as in the steel mixing stages. Instead the passageways can be molded or milled in the outer faces as illustrated in FIG. 13. The basic unit 18 for a mixing stage has the same conical inlet mixing chamber 26 formed in one face 76 (i.e., the front or entry face) of the unit with tangentially arranged open-faced passageways 82 (four of which are shown) formed in and planar with the front face. Similarly, the other or outlet mixing chamber 42 is formed in the opposite or rear exit face 84 of the unit with similarly formed tangential open-faced outlet passageways 86 (shown dotted). By employing an injection molding process, it will permit easy and inexpensive mass fabrication of mixer stages of various sizes and design and will eliminate the need for having to provide means for making the orifice of variable size, since it would be relatively inexpensive to fabricate stages with different size orifices. In an assembled series of molded stages, the resulting mixture from each stage exits tangentially from the chamber 42 through passageways 86 and is transferred directly (in an axial direction) through the aligned opening (which correspond to those aligned with members 38) in the gasket 78 and into the aligned corresponding inlet tangential passageways 82 disposed on the opposite side of that gasket opening in the front face 80 of the next adjoining stage.

As previously mentioned, the particle fraction of the resultant mixed stream at the end of N stages will be equal to $1/X^n$ of the incoming streams. It has been shown that by employing four inlet liquid streams with, for example, six stages, the fractioning, i.e. subdivision of particle size, is equal to $1/4^6$ or 1/4096. This means that the result of mixing is carried out to the fineness of 1/4096 of the original size of the particles before mixing. The subdivision and recombination of streams has been shown to be an extremely efficient operation when employing the present invention. This can be shown by the following table where the invention was applied to a copper extraction by liquid membrane process.

The copper extraction process typically involves mixing mine water leached out by sulfuric acid from low grade copper mine with liquid membrane emulsion which contains LIX (liquid ion exchange), surfactant and solvent oil.

In the table below slightly different bladeless mixers of different orifice diameters as discussed hereafter, were used for (1) and (2), while three standard static mixers assembled in series were used for (3).

TABLE

COPPER EXTRACTION PROCESS DATA

| | Residence Time | $Cu^{++}$ Extraction |
|---|---|---|
| (1) | 1.059 seconds | 42% |
| (2) | 1.140 seconds | 53% to 59% |
| (3) | 1.2 seconds | 33% |
| | **Swell of Emulsion** | **Pressure Drop** |
| (1) | 0 | 20–26 K Pa (2.90 to 3.77 psi) |
| (2) | 0 | 35–39 K Pa (5.07 to 5.65 psi) |
| (3) | 7% | 40 K Pa (5.80 psi) |

The orifice diameter employed in obtaining the above data in (1) was a 3/32 inch orifice diameter. By changing to a 1/16 inch orifice, this resulted in increased extraction of copper as anticipated, with a slight increase in pressure drop but maintaining no swell under the same conditions and only replacing the mixer. In (3) above, with three standard static mixers (made by KENICS Corporation) in series, the copper extraction was less, pressure drop was more, in addition to swell of emulsion which is undesirable, all of which was due to comparatively inefficient mixing.

The pressure drop is taken across the mixer, while residence time is calculated from the cavity volume and the measured flow (cc/min). The foregoing is typical of the results obtained from experimentation with the present invention. Various other possible applications for mixers according to the present invention include, for example, the mixing of organic and inorganic streams for use in a liquid membrane copper extraction process (which was the basis of the aforementioned experimentation), uranium separation techniques where the effectiveness of ultimate chemical separation depends on how effective the initial mixing of the streams is, and other typical fields of application which are considered within the scope of this invention and include for example, batteries on fuel cells the mixing of electrolytes with fuel or components of electrolytes and solvents or other catalytic fluids to enhance the performance of the electrochemical reaction so that the final product (fuel cell, battery, etc.) is economically feasible, that is, lowering the cost per watt energy stored or generated.

Liquid/liquid mixing has been shown to be very effective; however, the mixer also has utility for mixing other fluids such as gas/liquid, gas/gas, solid (powder)-/liquid and even solid/solid mixtures, the only variable being that the outlet and inlet residence time in each stage, as well as the orifice sizes, would be determined for each particular application. The size of the particular conical inlet mixing chamber determines the amount of residence time which the mixed streams would have and thereafter, the size of the particular orifice used would determine the velocity of the mixed stream in its translational or linear path of movement. Finally, the volume of the outlet conical mixing chamber likewise determines the residence time of the mixed streams in the outlet. Thus, it is seen that the effective mixing desired is not only a function of residence time within the various mixing chambers, but also is a function of the size of the orifice (diameter) and the number of stages employed. These are all deemed to be design expedients which are within the skill of those working the art and can be determined by proper experimentation for each particular situation. Also, while there has been shown a preferred embodiment for mixing four streams, it is also possible to employ more or less streams depending upon the number of streams available and the type and extent of mixing desired. For example, by increasing the size of the orifice in a particular stage, the residence time within the inlet chamber and outlet chamber is decreased and there is a corresponding decrease in the pressure drop, as well as the amount of extracted material such as in the copper extraction process.

In operation of the mixer according to the invention, the desired number of streams are pumped under pressure or by gravity into the inlet state 16*a* of the mixer. The streams enter through conduit 20 into inlet stage mixing cavity 74 from which they are extracted tangentially through openings 32 and then transferred through the transfer tubular connections 38 to the next succeeding stage 18*a*. These divided streams then are directed tangentially about the chamber periphery through 34, 36, 32 into the inlet vortex mixing chamber 26 in a uniform circumferential direction, whereupon there is created a helical vortex in the inlet chamber. This vortex decreases or converges due to the converging conical shape of the inlet mixing cavity 26 and at the apex end of the cavity, translates linearly through an orifice 52 which causes an increase in stream flow velocity and an increased mixing effect due to the confinement of the streams in the orifice, whereupon it exits into the outlet mixing cavity 42, which is also conically-shaped but has a diverging configuration with respect to the orifice. This results in a stream of decreasing rotational vortex velocity, whose direction is opposite to that of the inlet vortex due to the orientation of the tangential outlet passageways 46 at the cavity end where the mixture is withdrawn via 48, 50 and transferred through members 38 to the next succeeding stage 18*b*, etc. in the same manner as described heretofore. This can be seen by referring to FIG. 11 wherein the essentially same procedures would be repeated throughout the several stages, until arriving at the outlet stage 16*b* where the streams enter through openings 32 tangentially in the same direction about the periphery of the outlet chamber 76 and are withdrawn therefrom via the outlet conduit 20.

From the foregoing it can be seen that there is provided a novel bladeless mixer which is capable of mixing a plurality of streams and does not have any fixed blades or other similar obstructions and the like within the mixing chambers, one which can be easily cleaned and has low initial and operational maintenance costs because of the absence of any such blades and obstructions within the mixing area. Further, it is a very simple matter to interchange the various mixing stages and provide for variation in the extent and degree of mixing, depending upon the particular use to which the resultant stream is put. The size of the dispersion, that is, the extent of comingling between the particles of the various inlet streams is effectively controlled by the inlet velocities into each chamber which is a function of pressure, flow viscosity of the stream, and the volume of pressure, flow viscosity of the stream, and the volume to be flowed through.

In addition there is a renewal of the interface, that is, a remixing of the streams, which is made possible by the repeated division and recombination of the stream mixture throughout the various stages. Also, it is possible along the mixer to tap out a portion of the mixed stream, for sampling purposes or a specific use, inspection, measurement or analysis for monitoring the process or reaction, if any, during the mixing sequence, or any instrumentation. This easily can be accomplished by connecting one of the outlet passageways to a particular instrument or other unit for its intended purpose. A further feature is the interchangeability of the sections, either by adding or removing stages as desired.

Other types of turbulent mixers (such as motordriven blade mixer) can be used as a pre-mixer before the individual streams are fed into the bladeless mixer of this invention. A "settling" tank also can be used after this mixer to increase the residence time to allow more contact between the streams so mixed in the bladeless mixer.

While a particular preferred embodiment of the invention has been shown and described and various modifications thereof suggested, it will be understood that the true spirit and scope of the invention is set forth in the appended claims, which embrace other modifications and embodiments which will occur to those of ordinary skill in the art.

Having thus set forth the invention, what is claimed is:

1. A device for mixing a plurality of streams, comprising: chamber means for mixing said streams, at least two circumferentially spaced peripheral inlet passageways for said chamber means at a first end thereof for directing said streams into said chamber means in a substantially tangential direction for creating a converging inlet vortex having increasing rotational velocity in a first direction in said chamber means comprising a mixture of said streams, and peripheral outlet passageway means at the opposite end of said chamber means for receiving and extracting said mixture of said streams from said chamber means as an outlet vortex having decreasing rotational velocity in a direction opposite to said first direction.

2. The device of claim 1 wherein said peripheral outlet passageway means comprises at least two circumferentially spaced peripheral outlet passageways for directing said mixture from said chamber means in a substantially tangential direction.

3. The device of claim 2 wherein said inlet passageways and said outlet passageway means are tangentially disposed with respect to said chamber means.

4. The device of claim 2 wherein said chamber means comprises a conically-shaped inlet mixing chamber for developing a shrinking vortex for said streams entering through said inlet passageways, said inlet mixing chamber having a base end and an apex end and said inlet passageways being located at said base end of said inlet mixing chamber, a conically-shaped outlet mixing chamber for developing a reverse expanding vortex for said streams with respect to said shrinking vortex in said inlet mixing chamber, said outlet mixing chamber having a base end and an apex end, said outlet passageways being located at said base end of said outlet mixing chamber, and orifice means connecting said inlet mixing chamber with said outlet mixing chamber.

5. The device of claim 4 wherein said apex end of said inlet mixing chamber is located adjacent said apex end of said outlet mixing chamber and said base ends of said inlet and outlet mixing chambers are located at opposite ends of said device.

6. The device of claim 4 wherein said inlet and outlet mixing chambers are axially symmetrical with respect to said orifice means.

7. The device of claim 4 wherein said orifice means is defined by directly adjacent apex ends of said inlet and outlet mixing chambers.

8. The device of claim 4 wherein said orifice means is removably mounted between said inlet and outlet mixing chambers enabling modification of the orifice size and velocity of said inlet vortex of said streams as it passes therethrough.

9. The device of claim 4 wherein said orifice means includes an inlet opening and outlet opening and a central opening interconnecting said inlet and outlet openings, said inlet opening having substantially a conical shape substantially complementary with that of said inlet mixing chamber and said outlet opening having substantially a conical shape substantially complementary with that of said outlet mixing chamber, the surfaces of said inlet and outlet openings of said orifice means being substantially aligned with the adjoining sides of said inlet and said outlet mixing chambers.

10. The device of claim 1 including orifice means located in said chamber means between said inlet passageways and said outlet passageway means.

11. The device of claim 10 wherein said orifice means is removable from said chamber means for enabling modification of the orifice size and velocity of said inlet vortex of said streams as it passes therethrough.

12. The device of claim 10 wherein said orifice means includes an opening of uniform diameter and coaxial with the axes of said inlet and outlet mixing chambers.

13. The device of claim 1 wherein said inlet passageways and said outlet passageway means comprise a first channel extending in an axial direction above said chamber means and a second channel substantially perpendicular to said first channel and tangentially arranged with respect to said chamber means.

14. The device of claim 1 including removable means at opposite ends of said device for sealing said chamber means and for substantially preventing leakage therefrom of said fluid streams.

15. The device of claim 1 including opposed first and second outer end surfaces and wherein said inlet passageways are provided in and planar with said first outer end surface and said outlet passageways are provided in and planar with said second outer end surface.

16. A system for use in the mixing of a plurality of fluid streams comprising: a plurality of interconnected mixing devices in fluid transfer relation, each of said devices comprising chamber means for mixing said fluid streams and inlet and outlet passageway means, said inlet and said outlet passageway means being tangentially arranged with respect to said chamber means in each of said devices, respectively, for tangentially directing said fluid streams into and out from said inlet and outlet passageway means, said inlet passageway means introducing said streams into said chamber means in a first rotational direction and coacting with said chamber means for creating a converging inlet vortex of increasing rotational velocity in said first direction, said outlet passageway means extracting said vortex from said chamber means as an outlet vortex having a rotational direction opposite to said first direction, and interconnecting passageway means between the outlet passageway means and inlet passageway means of adjacent ones of said members for transferring the mixed fluid streams between said adjacent mixing devices.

17. The system of claim 16 including seal means between adjacent ones of said devices for preventing leakage of said streams.

18. The system of claim 16 wherein said inlet member includes a mixing chamber having inlet and outlet passageway means and said outlet member has a mixing chamber including inlet and outlet passageway means.

19. The device of claim 16 including seal means for sealing opposite ends of said chamber means in each of said devices such that said fluid streams enter and exit each of said members only via said inlet and outlet passageways, respectively, in a tangential direction.

20. The system of claim 16 wherein said interconnecting passageway means comprises an apertured gasket seal.

21. A method of mixing a plurality of fluid streams in a mixing chamber comprising the steps of:

(a) tangentially directing each of said streams into the inlet end of said mixing chamber such that said streams mix to form a vortex of increasing rotational velocity in a first direction;

(b) translating said vortex through said mixing chamber to the outlet end thereof wherein said vortex is characterized by a decreasing rotational velocity in a direction opposite the said first direction; and (c) tangentially extracting said mixed streams in a direction opposite to the inlet direction from said mixing chamber.

22. The method of claim 21 including the step of:

(d) passing said vortex through an orifice disposed between the inlet and outlet ends of said mixing chamber for increasing the velocity of translation of said inlet vortex.

23. The method of claim 22 including the steps of:

(e) forming a shrinking vortex between said inlet end and said orifice;

(f) passing said shrinking vortex through said orifice; and (g) forming a reverse expanding vortex relative to said shrinking vortex between said orifice and said outlet end.

24. The method of claim 21 including the steps of:

(d) connecting a series of said mixing chambers in seriatum;

(e) repeating the steps (a), (b), and (c) in each of said chambers; and (f) varying the velocity of said vortex as it passes through selected ones of said chambers.

25. The method of claim 24, including the steps of:

(g) varying the velocity of said vortex by providing different sized orifices in selected ones of said chambers for passage of said vortex therethrough.

26. A mixing device for use in mixing a plurality of streams, comprising: a member including a converging conical mixing chamber which extends from a first end toward said opposite end, and a second divering conical mixing chamber extending from the apex of said first chamber to said opposite end of said member; tangentially disposed circumferentially spaced inlet means for introducing said streams into said first chamber at the inlet end thereof in a first direction and tangentially disposed outlet means located at said opposite end of said member for extracting said mixed streams in a direction opposite to said first direction; and orifice means interconnecting said first and second mixing chamber for causing a converging helical vortex created in said first mixing chamber to translate linearly through said orifice means into said outlet mixing chamber at an increased velocity, wherein a diverging vortex is developed which has a rotational direction opposite to that of said converging helical vortex.

27. The mixing device of claim 26 wherein said orifice means is removably disposed between said first and second mixing chambers for enabling modification of the size thereof and the velocity of said inlet vortex of said streams as it passes therethrough.

28. The mixing device of claim 27 wherein said orifice in said removable orifice means comprises a hexagonal configuration to facilitate removal.

29. The mixing device of claim 27 wherein said orifice means is threaded about its outer periphery.

30. The mixing device of claim 26 wherein said inlet and outlet means are located in substantially the same transverse plane.

31. The device of claim 26 including oposed first and second outer end surfaces at said first end and at said opposite end of said member, said inlet means being planar with said first surface and said outlet means being planar with said second surface.

32. A system for use in the mixing of a plurality of fluid streams comprising in combination: a plurality of inter-connected mixing devices in fluid transfer relationship, each of said devices comprising chamber means for mixing said fluid streams and inlet and outlet passageway means, said inlet and said outlet passageway means being tangentially arranged with respect to said chamber means in each of said devices, respectively, for tangentially directing said fluid streams into said chamber means as a vortex having a first rotational direction and from said chamber means into said outlet passageway means in a rotational direction opposite from that of said first direction; seal means disposed between adjacent ones of said devices for enabling transfer of fluid streams between adjacent ones of said mixing devices without leakage and including apertures aligned with corresponding outlet and inlet passageway means of said adjacent devices.

33. A system for use in the mixing of a plurality of fluid streams comprising: a plurality of interconnected mixing devices in fluid transfer relation, each of said devices comprising chamber means for mixing said fluid streams having inlet and outlet passageway means, said inlet and said outlet passageway means being tangentially arranged with respect to said chamber means in each of said devices, respectively, for tangentially directing said fluid streams into and out from said chamber means and interconnecting passageway means between the outlet passageway means and inlet passageway means of adjacent ones of said members for transferring the mixed fluid streams between said adjacent mixing devices, said chamber means in selected ones of said mixing devices comprising a first conically-shaped inlet mixing chamber and a second conically-shaped outlet mixing chamber, said first and second mixing chambers being symmetrically arranged in said selected ones of said devices, orifice means interconnecting said inlet and outlet mixing chambers in said selected ones of said devices, said inlet passageway means arranged for tangentially directing said streams into said inlet mixing chamber at an end thereof for developing a shrinking vortex in said inlet mixing chamber for linear passage through said orifice means and said outlet passageway means being disposed at the end of said outlet mixing chamber for tangentially directing said streams therefrom.

34. The system of claim 33 wherein said devices include at least first and second different sized orifice means for passage of said shrinking vortex therethrough.

* * * * *